US005361414A

United States Patent [19]

Smith

[11] Patent Number: 5,361,414

[45] Date of Patent: Nov. 8, 1994

[54] HOSPITAL PRIVACY GOWN

[76] Inventor: Astor M. Smith, P.O. Box 863, Wheatly Heights, N.Y. 11798

[21] Appl. No.: 128,093

[22] Filed: Sep. 29, 1993

[51] Int. Cl.[5] ..... A41D 1/00; A41D 10/00

[52] U.S. Cl. ..... 2/114; 2/105

[58] Field of Search ..... 2/51, 69, 69.5, 105, 2/106, 114, 115, 70, 71, 72, 73, 75, 80, 211, 218, 216, 219, 220, 46, 48

[56] References Cited

U.S. PATENT DOCUMENTS

| | | | |
|---|---|---|---|
| 1,018,012 | 2/1912 | Shapiro | 2/221 |
| 2,335,971 | 12/1943 | Scholle | 2/221 |
| 2,556,931 | 6/1951 | Miller | 2/114 |
| 2,707,282 | 5/1955 | Paterson | 2/114 |
| 2,975,430 | 3/1961 | Zanger | 2/211 |
| 3,751,730 | 8/1973 | Zamist | 2/114 |
| 4,215,434 | 8/1980 | Barron | 2/114 |
| 4,964,173 | 10/1990 | Gordon et al. | 2/114 |

*Primary Examiner*—Jeanette E. Chapman
*Attorney, Agent, or Firm*—Michael I. Kroll

[57] ABSTRACT

A hospital privacy gown is provided, which consists of a body garment having a front portion, a vertically split rear portion divided into two segments, a pair of sleeves and a neck opening, so that the body garment can be worn by a patient. A fastener is for retaining the two segments of the vertically split rear portion together at the neck opening. A structure is for covering up a lower separation of the two segments of the vertically split rear portion of the body garment. A component is for securing in an adjustable manner, the covering up structure at a waist location of the body garment to properly cover the body of the patient for personal modesty and be quickly opened for examination and access thereto.

1 Claim, 2 Drawing Sheets

HOSPITAL PRIVACY GOWN

BACKGROUND OF THE INVENTION

1. Field of the Invention The instant invention relates generally to medical garments and more specifically it relates to a hospital privacy gown.

2. Description of the Prior Art

Numerous medical garments have been provided in prior art that are adapted to be worn by patients for hospital, surgery and examination purposes. While these units may be suitable for the particular purpose to which they address, they would not be as suitable for the purposes of the present invention as heretofore described.

SUMMARY OF THE INVENTION

A primary object of the present invention is to provide a hospital privacy gown that will overcome the shortcomings of the prior art devices.

Another object is to provide a hospital privacy gown that is constructed to properly cover a patients body for personal modesty and be quickly opened for examination and access thereto.

An additional object is to provide a hospital privacy gown that is equipped with adjustable straps to accommodate patients of varying girths.

A further object is to provide a hospital privacy gown that is simple and easy to use.

A still further object is to provide a hospital privacy gown that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4:
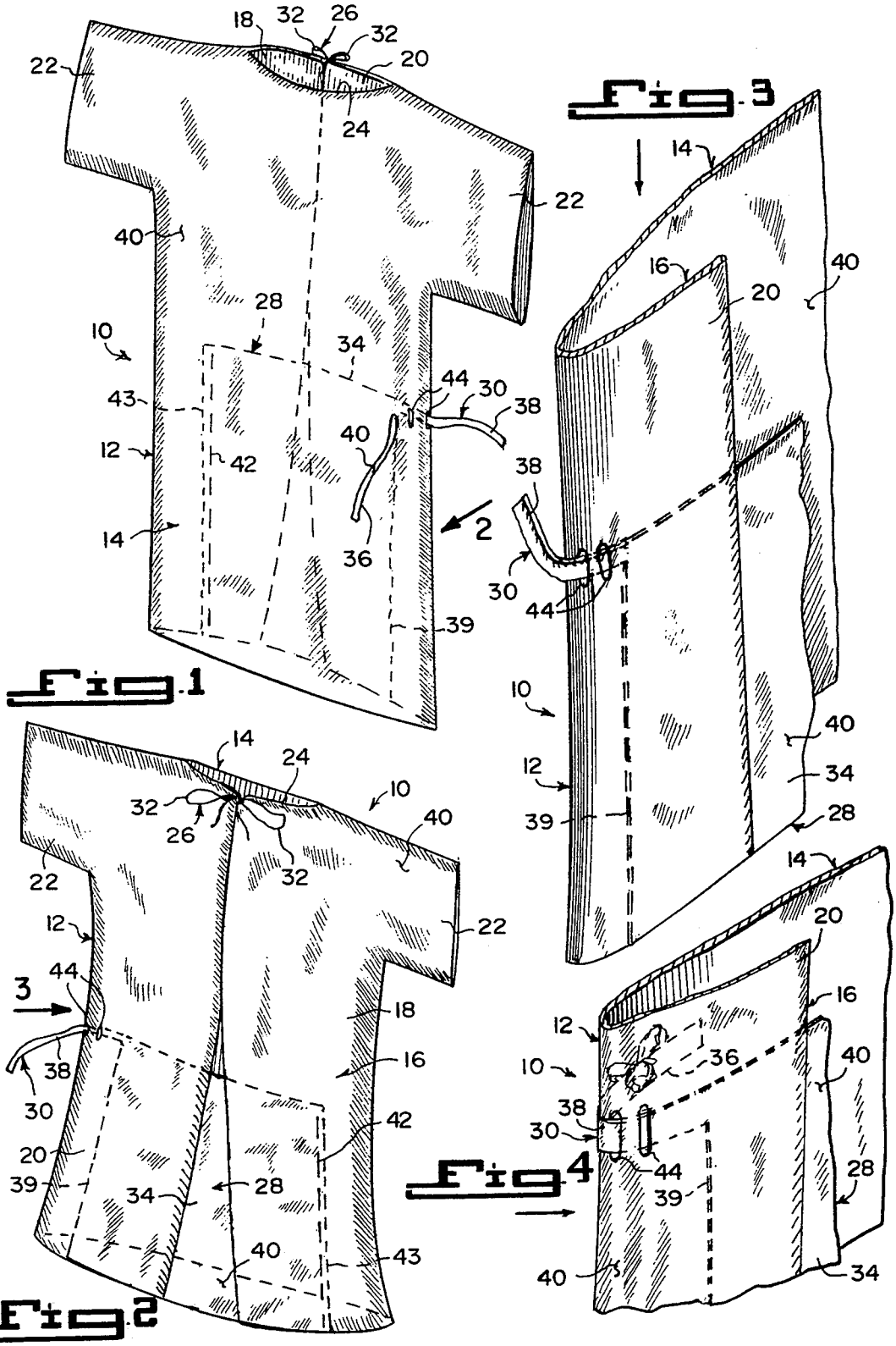
FIG. 1 is a front perspective view of a first embodiment of the instant invention.
FIG. 2 is a rear perspective view taken in the direction of arrow 2 in FIG. 1.
FIG. 3 is a rear perspective view of a portion thereof taken in the direction of arrow 3 in FIG. 2.
FIG. 4 is a rear perspective view of a portion thereof similar to FIG. 3, showing the rear strap extending through the medium sized slot and tied to the front strap.

Turning now descriptively to the drawings, in which similar reference characters denote similar elements throughout the several views, FIGS. 1 through 4 illustrate a hospital privacy gown 10, which comprises a body garment 12 having a front portion 14, a vertically split rear portion 16 dividend into two segments 18, 20, a pair of sleeves 22 and a neck opening 24, so that the body garment 12 can be worn by a patient. A fastener 26 is for retaining the two segments 18, 20 of the vertically split rear portion 16 together at the neck opening 24. A structure 28 is for covering up a lower separation of the two segments 18, 20 of the vertically split rear portion 16 of the body garment 12. A component 30 is for securing in an adjustable manner the covering up structure 28 at a waist location of the body garment 12, to properly cover the body of the patient for personal modesty and be quickly opened for examination and access thereto.

The retaining fastener 26 is a pair of tie strings 32, each affixed at one end to one side edge of each segment 18, 20 of the vertically split rear portion 16 at the neck opening 24, so that the free ends of the tie strings 32 can be tied together. The covering up structure 28 is a panel 34, extending upwardly between a bottom edge and the waist location of the two segments 18, 20 of the vertically split rear portion 16 of the body garment 12.

The securing component 30 includes a first strap 36 affixed at one end to one side of the front portion 14 of the body garment 12 at the waist location. A second strap 38 extends outwardly from a first side 39 of the panel 34 at the waist location, so that the free ends of the first and second straps 36, 38 can be tied together.

The front portion 14, the two segments 18, 20 of the vertically split rear portion 16 and the sleeves 22 of the body garment 12 are integral and fabricated out of a cloth material 40. The second strap 38 and the panel 34 are integral and fabricated out of the same cloth material 40. The first strap 36 is also fabricated out of the same cloth material 40.

The panel 34 is sewn at 42 along a second side 43 under and to the first segment 18, so that the first side 39 of the panel 34 will overlap under the second segment 20 of the vertically split rear portion 16.

The body garment 12 has a plurality of side slots 44 between the front portion 14 and the second segment 20 of the vertically split rear portion 16 at the waist location, so that the second strap 38 can be inserted through any one of the side slots 44 and be tied to the first strap 36 on the front portion 14, to accommodate patients of varying girths.

Figure 5:
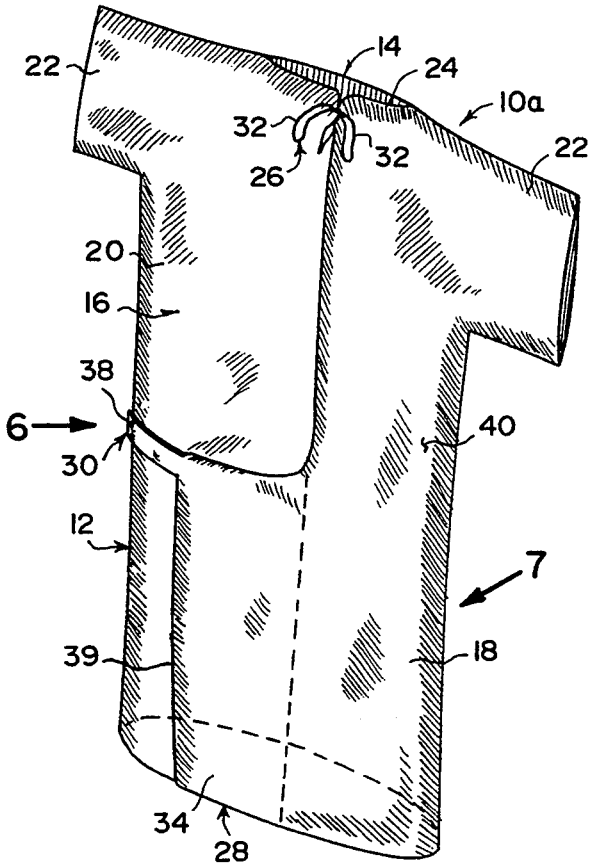
FIG. 5 is a rear perspective view of a second embodiment of the instant invention.
Figure 7:
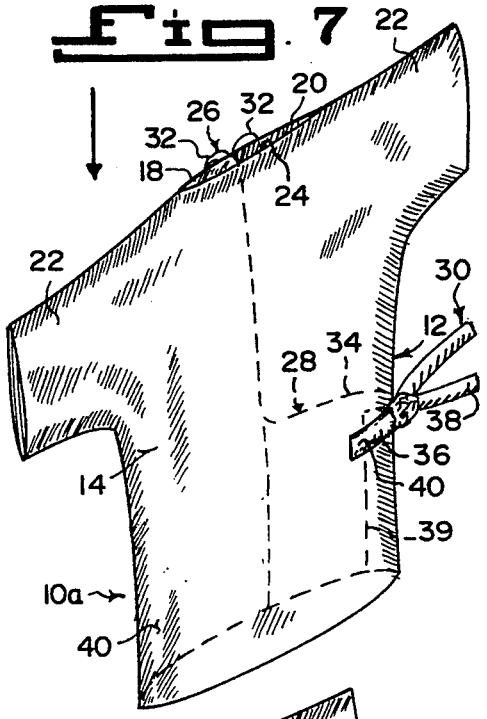
FIG. 7 is a front perspective view taken in the direction of arrow 7 in FIG. 5, showing the front and rear straps tied together.
Figure 6:
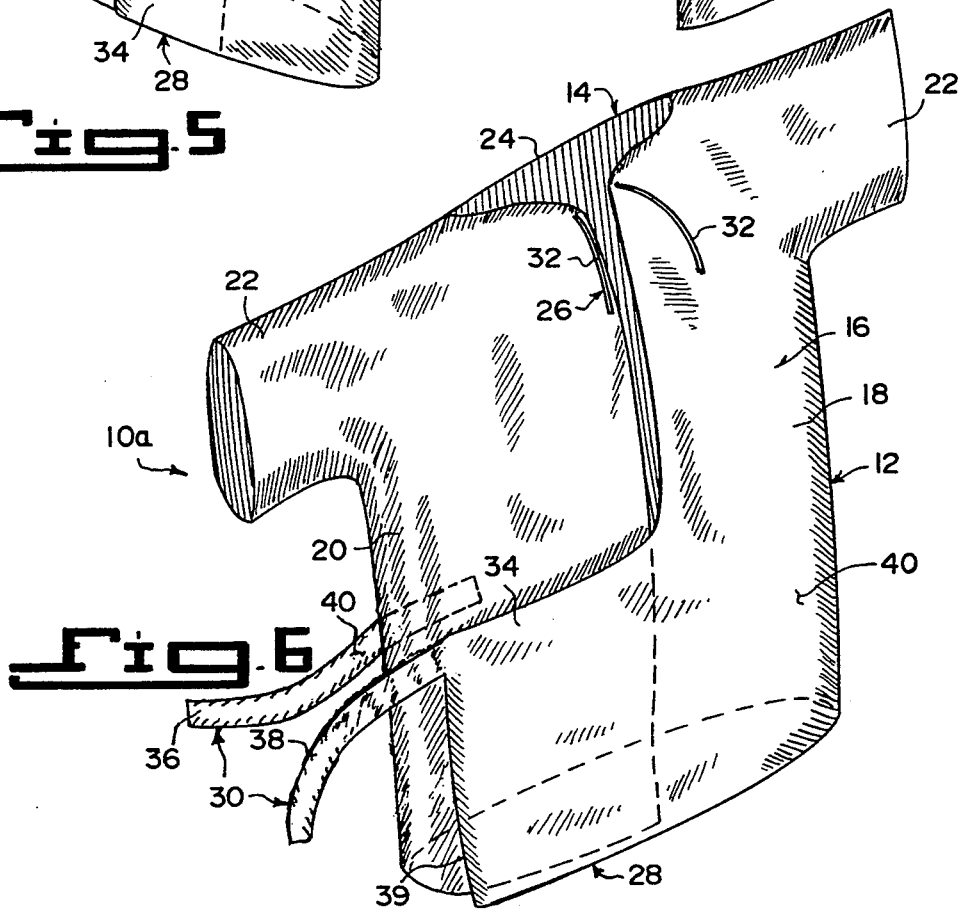
FIG. 6 is a rear perspective view taken in the direction of arrow 6 in FIG. 5, showing the rear strap untied.

FIGS. 5 through 7 show a modified hospital privacy gown 10*a*. The front portion 14, the two segments 18, 20 of the vertically split rear portion 16, the sleeves 22 of the body garment 12, the panel 34 and the second strap 38 are integral and fabricated out of a cloth material 40. The first side 39 of the panel 34 will overlap over the second segment 20 of the vertically split rear portion 16. This allows the second strap 38 to extend partially around and be tied to the first strap 36 on the front portion 14, to accommodate patients of varying girths. The first strap 36 is fabricated out of the same cloth material 40.

OPERATION OF THE INVENTION

To use the hospital privacy gown 10 the following steps should be taken:

1. Place each arm of the patient through each sleeve 22 with the neck of the patient extending out from the neck opening 24.
2. Tie the tie strings 32 together.
3. Insert the second strap 38 through one of the side slots 44 under the second segment 20.

4. Secure the second strap 38 partially around to the front portion 14 of the body garment 12.
5. Tie the front strap 36 on the front portion 14 to the second strap 38 to secure the panel 34 underneath and in place between the lower separation of the vertically split rear portion 16.

To use the hospital privacy gown 10*a* the following steps should be taken:

1. Place each arm of the patient through each sleeve 22 with the neck of the patient extending out from the neck opening 24.
2. Tie the tie strings 32 together.
3. Secure the second strap 38 partially around to the front portion 14 of the body garment 12.
4. Tie the front strap 36 on the front portion to the second strap 38 to secure the panel 34 over and in place on the second segment 20.

LIST OF REFERENCE NUMBERS

10 hospital privacy gown
10*a* modified hospital privacy gown
12 body garment
14 front portion of 12
16 vertically split rear portion of 12
18 first segment of 16
20 second segment of 16
22 sleeve of 12
24 neck opening of 12
26 retaining fastener
28 covering up structure
30 securing component
32 tie string
34 panel
36 first strap on 14
38 second strap on 34
39 first side of 34
40 cloth material
42 sewn
43 second side of 34
44 side slot in 12

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hospital privacy gown which comprises:

a) a body garment having a front portion, a vertical split rear portion divided into two segments, a pair of sleeves and a neck opening, so that said body garment can be worn by a patient, said front portion, said two segments of said vertically split rear portion and said sleeves of said body garment are integral and fabricated out of a cloth material;

b) means for retaining said two segments of said vertically split rear portion together at said neck opening, said retaining means being a pair of tie strings, each affixed at one end to one side edge of each segment of said vertically split rear portion at said neck opening, so that the free ends of said tie strings can be tied together;

c) means for covering up a lower separation of said two segments of said vertically split rear portion of said body garment, said covering up means is a panel extending upwardly between a bottom edge and a waist location of said two segments of said vertically split rear portion of said body garment, said panel being sewn along a second side under and to one of said segments, so that a first side of said panel will overlap under said second segment of said vertically split rear portion; and d) means for securing in an adjustable manner, said covering up means at a waist location of said body garment to properly cover the body of the patient for personal modesty and be quickly opened for examination and access thereto, said securing means includes a first strap affixed at one end to one side of said front portion of said body garment at the waist location and a second strap extending outwardly from said first side of said panel at the waist location, so that the free ends of said first and second straps can be tied together, said first strap being fabricated out of said same cloth material, and second strap and said panel being integral and fabricated out of said same cloth material.

* * * * *